US008684298B2

(12) United States Patent
Opfer et al.

(10) Patent No.: US 8,684,298 B2
(45) Date of Patent: Apr. 1, 2014

(54) TURN-BAR

(75) Inventors: Shamai Opfer, Mazkeret Batya (IL); Avi Namer, Rishon Le-Zion (IL); Eyal Peleg, Zoran (IL)

(73) Assignee: Hewlett-Packard Development Company, L.P., Houston, TX (US)

( * ) Notice: Subject to any disclaimer, the term of this patent is extended or adjusted under 35 U.S.C. 154(b) by 1105 days.

(21) Appl. No.: 12/207,194

(22) Filed: Sep. 9, 2008

(65) Prior Publication Data

US 2010/0059567 A1 Mar. 11, 2010

(51) Int. Cl.
*B65H 23/32* (2006.01)

(52) U.S. Cl.
USPC ..... 242/615.12

(58) Field of Classification Search
USPC ..... 226/489, 97.3; 242/615.12, 615.21
See application file for complete search history.

(56) References Cited

U.S. PATENT DOCUMENTS 3,734,487 A * 5/1973 Treff ..... 270/52.08
4,863,087 A * 9/1989 Kohler ..... 242/615.21
5,016,801 A * 5/1991 Gilat et al. ..... 242/615.21
5,108,022 A * 4/1992 Birkmair et al. ..... 242/615.21
5,357,859 A * 10/1994 Eckert ..... 101/228
5,464,143 A * 11/1995 Hansen ..... 242/615.12
5,520,317 A * 5/1996 Eckert et al. ..... 242/615.12
5,823,464 A * 10/1998 Bohn et al. ..... 242/615.21
6,013,212 A * 1/2000 Planeta et al. ..... 264/40.7
6,047,922 A * 4/2000 Michalik ..... 242/615.21
6,450,382 B1 * 9/2002 Ohno ..... 226/21
6,575,399 B1 * 6/2003 Lamothe ..... 242/615.21
2004/0113012 A1 * 6/2004 Boucher ..... 242/615.21
2008/0029640 A1 * 2/2008 Chiu et al. ..... 242/615.21

* cited by examiner

*Primary Examiner* — Sang Kim
*Assistant Examiner* — Scott Haugland

(57) ABSTRACT

A turn-bar for adjusting orientation of a web includes a plurality of roll bars. Positions of at least two bars of the plurality of roll bars are movable with respect to a direction of travel of the web. An orientation of the web passing through the bars may be changed by adjusting a position of the at least two bars without removal of the web from the turn-bar. A method of selectively inverting or not inverting a web includes changing a position of at least two roll bars of a turn-bar apparatus with respect to a direction of travel of the web, where the web is not inverted by the turn-bar apparatus when the at least two roll bars are in a first position, and the web is inverted by the turn-bar apparatus when the at least two roll bars are in a second position.

16 Claims, 5 Drawing Sheets

TURN-BAR

BACKGROUND

Web presses are rotary printing presses that print on a continuous roll of paper or other material called a web, rather than on individual sheets of cut paper. Web paper is less expensive than cut paper, and web presses are suited to any type of large-volume and/or high-speed printing. They are most commonly used to print newspapers, magazines, and catalogs. Unlike sheet-fed presses, web presses can also print on plastic or foil surfaces for package and label printing.

Many common web press print jobs are executed by passing a web between two printers. In one such job, requiring printing on two sides of a web, a first engine prints on one side of the web, and a second print engine prints on the other side. Another such job requires printing on one side only, but the first printer executes only a portion of the print (such as black and white text) and the second printer executes the remaining portion of the print (such as color highlights). This technique optimizes speed in certain print jobs since color generally prints slower than black and white but is often less pervasive on a page.

BRIEF DESCRIPTION OF THE DRAWINGS

The accompanying drawings illustrate various embodiments of the principles described herein and are a part of the specification. The illustrated embodiments are merely examples and do not limit the scope of the claims.

Throughout the drawings, identical reference numbers designate similar, but not necessarily identical, elements.

DETAILED DESCRIPTION

Figure 1:
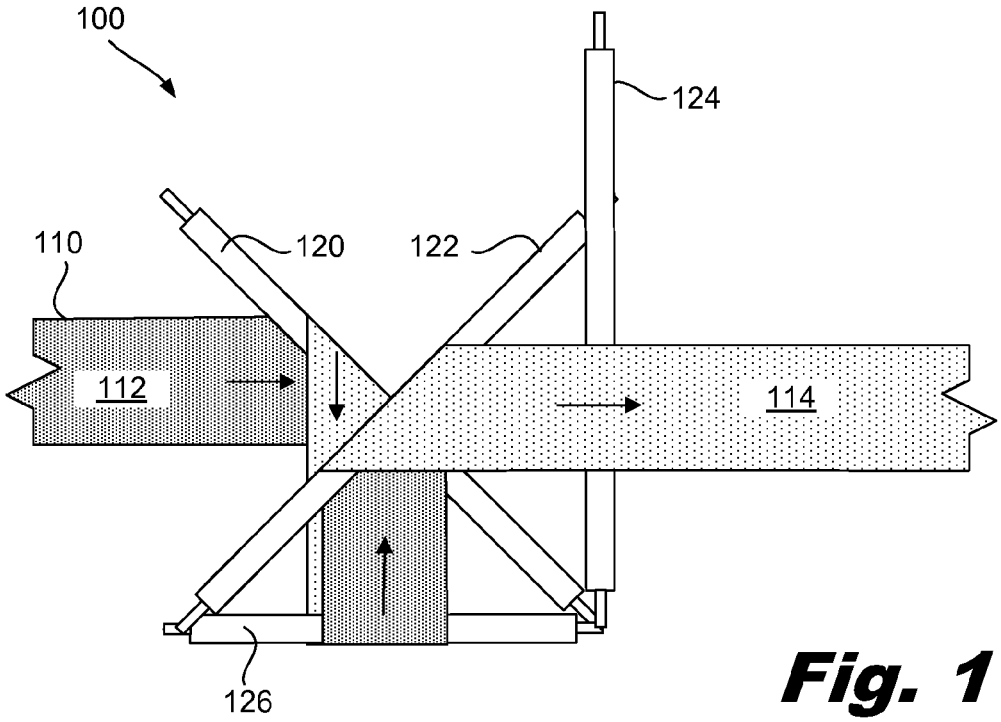
FIG. 1 is a diagram of one illustrative turn-bar mechanism in an inverting mode, according to one embodiment of principles described herein.

The following specification describes devices and techniques for manipulating web orientation in a web press system. Particularly, the present specification describes devices and techniques which eliminate the need to cut, rethread, and splice a web to adjust its orientation.

In web press systems, the orientation of the web may be manually set prior to the beginning of the print process. Mechanisms called turn-bars are used to invert the web between different printers or print engines so that printing can be done on both sides. These mechanisms used to turn a web to a desired orientation will be referred to herein as "turn-bars" or "turn-bar mechanisms." Therefore, as used in the present specification and in the appended claims, the term "turn-bar" refers to a mechanism using one or more roll bars to adjust the orientation or position of a web with respect, for example, to a print engine.

In web press systems that employ turn-bars, the web is threaded through such mechanisms according to the print needs. For example, if the print job requires double sided printing, the web will be threaded through a turn bar so as to receive printing on both a first side and, when inverted by the turn bar, on a second side. If the print job only requires single sided printing, the web may bypass the turn-bar so as to keep the orientation of the web constant, meaning that the web is not inverted for printing on the second side.

After the web is threaded, the print job can then begin. However, it is sometimes desirable to switch between double sided and single sided modes on a single print job or a single web. In such cases, the web may be cut, rethreaded through the turn-bar mechanism accordingly, and spliced back together. This can take considerable time and the splice becomes a weak point of the web which may rip during subsequent rethreading or print operations.

In the following description, for purposes of explanation, numerous specific details are set forth in order to provide a thorough understanding of the present systems and methods. It will be apparent, however, to one skilled in the art that the present apparatus, systems and methods may be practiced without these specific details. Reference in the specification to "an embodiment," "an example" or similar language means that a particular feature, structure, or characteristic described in connection with the embodiment or example is included in at least that one embodiment, but not necessarily in other embodiments. The various instances of the phrase "in one embodiment" or similar phrases in various places in the specification are not necessarily all referring to the same embodiment.

As mentioned previously, turn-bars can be selectively used by an operator to manipulate the orientation of a web for a particular print job. By using motorized bars that have the ability to swivel between positions, it is possible to automatically change the orientation of the web without cutting, rethreading, or splicing the web. This can significantly reduce the time and effort needed by a human to operate a web press, and reduce the danger of a tear because there is no splice.

According to one exemplary embodiment, a turn-bar made of four roll bars is used to selectively maintain or invert the orientation of a web with respect to one or more print engines. Each roll bar may comprise a roller, which may or may not be a driven roller, that rotates about its longitudinal axis to pass the web through the turn-bar. Some roll bars may not rotate, however, instead allowing the web to slide over a smooth surface of such a roll bar. The various types and exemplary combinations of roll bars in a turn-bar will be described in more detail below.

Within the structure of the turn-bar, two or more of these roll bars are moveable or swivel-able to different angles to change the path of the web through the turn-bar and, according to their orientation, can selectively maintain or invert the web orientation. Different orientations of these roll bars thus constitute different modes and result in different web orientations. In one exemplary mode, the orientation of the web as it exits the turn-bar is the same as when it enters the turn-bar. In another exemplary mode, the orientation of the web as it exits the turn-bar is inverted with respect to when it enters the turn-bar. According to one exemplary embodiment, the switching between these two modes is automated.

As used in the present specification and in the appended claims, the term "web press" refers to a system used to print symbols or images using any number of printing methods including, but not limited to offset printing, digital printing, or raised printing. The web press may employ one or more print engines, turn-bars, and other mechanisms for manipulation of the web and the generation of desired images thereon.

With regard to FIG. 1, an exemplary turn-bar mechanism in an inverting mode (100) is shown. The turn-bar is made up of a first roll bar (120), a second roll bar (122), a third roll bar (124), and a fourth roll bar (126). A web (110) with a first side (112) and a second side (114) is threaded through the turn-bar. When the first side (112) is facing out of the page in a figure, this will be referred to as face-up. When the second side (114) is facing out of the page in a figure, this will be referred to as face-down. The shading of the first side (112) with respect to the second side (114) is not necessarily the actual shading of the web (110) but is used for clarity in illustrating its orientation. Further, no frame or attachment mechanisms are shown for clarity of the position of the roll bars and how the web is threaded.

In one embodiment, the web (110) passes through the turn-bar (100) in the manner indicated by the arrows in FIG. 1. That is, the web (110) enters on the left, loops around the first roll bar (120), down to the fourth roll bar (126), up around the second roll bar (122), and over the third roll bar (124) and out of the turn-bar (100) to the right.

This illustrates the turn-bar (100) in an inverting mode. Thus, the orientation of the bars (120-126) and the threading of the web (110) through the bars (120-126) are such that the orientation of the web (110) as it enters the turn-bar is face up, but, as it exits the turn-bar, is face-down. Thus, the web (110) is inverted. This mode as shown in FIG. 1 will be referred to as an x-inverter mode due to the 'X' formed by the first and second bars (120, 122) and because of the resulting inversion of the web (110).

The roll bars (120-126) may be made of any combination of metal, plastic, rubber, or other materials. Further, the roll bars may be allowed to roll around their longitudinal axis. This allows the bars to roll with the movement of the web. According to one exemplary embodiment, the third and fourth bars (124, 126) can roll along their longitudinal axis. It is generally undesirable to allow diagonal roll bars (120, 122) to roll. This allows the web (110) to run more smoothly through the turn-bar and can help prevent paper jams. For this reason, it is recommended that in the mode shown in FIG. 1 that the first and second bars (120, 122) do not roll. Thus, despite their name as roll bars (120-126) they may or may not roll about their longitudinal axis.

The roll bars (120-126) may also have a plurality of air nozzles on their surfaces through which air may be forced. Such nozzles can reduce the friction between the web (110) and the roll bars (120-126) and result in a more even distribution of tension across the width of the web (110) leading to more accurate printing and reducing strain or damage to the web material. In general, roll bars should be locked into position such that air forced from the nozzles is between the web (110) and the roll bar. According to one embodiment, diagonal roll bars force air through air nozzles.

According to one exemplary embodiment, the configuration shown in FIG. 1 may be interposed between two print engines. For example, a print engine on the left may print on the first side (112) of the web and a second print engine on the right may print on the second side (114). This would allow for simultaneous printing on both sides of the web (110).

Figure 3:
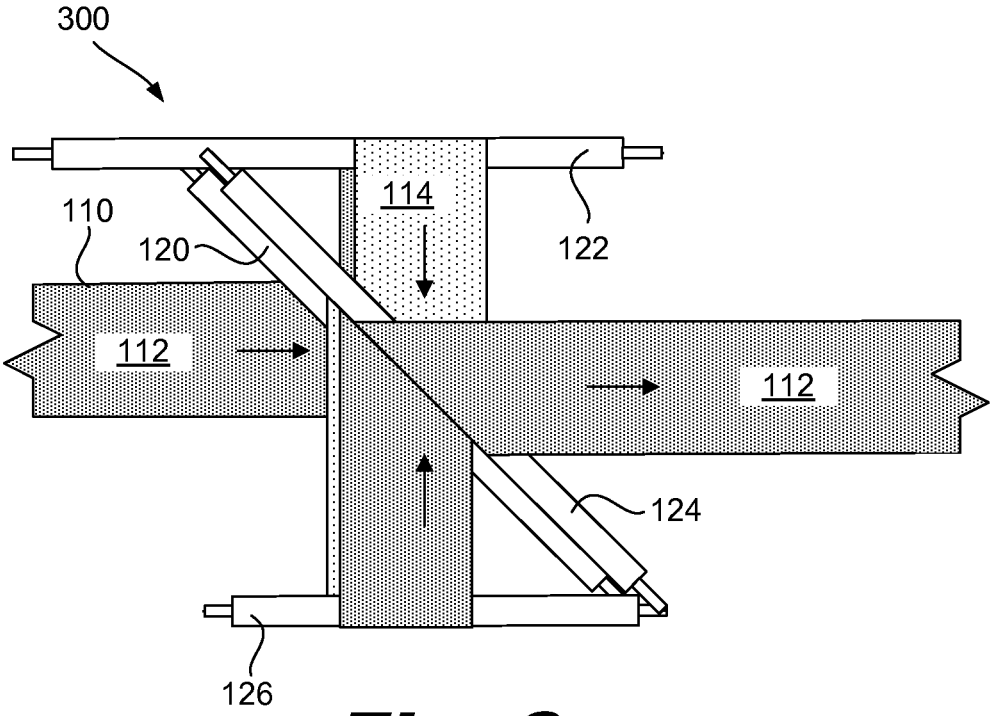
FIG. 3 is a diagram of one illustrative turn-bar mechanism in a keeper mode, according to one embodiment of principles described herein.

With regard to FIG. 3, the turn-bar in a second mode (300) is shown which maintains the same orientation of the web (110) from the input of the turn-bar to the output of the turn-bar. It should be noted that the same roll bars (120-126) and web (110) are represented in turn-bar (300) of FIG. 3, but their orientations are different. This turn-bar and mode (300) will be referred to herein as the z-keeper mode due to the 'Z' shape formed by the roll bars (120-126) and because the orientation of the web (110) is kept the same after passage through the turn-bar.

In one embodiment, the web (110) passes through the turn-bar in the manner indicated by the arrows in FIG. 3. That is, the web (110) enters on the left, loops around the first roll bar (120), down to the fourth roll bar (126), up around the second roll bar (122), around and over the third roll bar (124) and exits the turn-bar (300) on the right. The orientation of the roll bars (120-126) and the threading of the web (110) through the roll bars (120-126) are such that the orientation of the web (110) as it enters the turn-bar is face-up and remains face-up as it exits the turn-bar (300) as well. Thus, the web (110) orientation is not inverted.

Again, the configuration shown in FIG. 3 may be interposed between two print engines. For example, a print engine on the left may print on the first side (112) of the web and a second print engine on the right may also print on the first side (112). This allows for two printers to print simultaneous on the same side of the web (110). Further, because the web (110) in the z-keeper mode (300) enters and exits the turn-bar at the same place and in the same direction as in the x-inverter mode (100, FIG. 1), no movement of the print engines is needed when switching between these modes.

As mentioned in relation to the x-inverter mode (100, FIG. 1) some of the roll bars may be allowed to roll around their longitudinal axis, and some may not. According to one embodiment, when in the z-keeper mode, the second and fourth bars (122, 126) are allowed to roll, but the first and third bars (120, 124) do not rotate.

It will be noted that, because of the change in orientation of the roll bars between modes, some roll bars are in diagonal positions in certain modes but not in others. Because some bars may need to rotate in certain modes but not in others, the bars (120-126) may be selectively locked so that they will not roll, i.e. rotate about their longitudinal axis. For example, the second bar (122) may be locked to not rotate when the turn-bar is in the x-inverter mode (100, FIG. 1) and be free to roll when the turn-bar is in the z-keeper mode (300, FIG. 3). Along the same lines, the third roll bar (124) may be allowed to roll in the x-inverter mode (100, FIG. 1) and be locked to keep from rolling in the z-keeper mode (300, FIG. 3).

Further, as noted above, one or more of the roll bars (120-126) may have a plurality of air nozzles through which air may be selectively forced according to the mode of the turn-bar. According to one embodiment, in the x-inverter mode (100, FIG. 1) the second bar (122) may force air through a plurality of air nozzles and in the z-keeper mode (300, FIG. 3) the second bar may no longer force out air through a plurality of nozzles.

Again, when a bar is locked in into position it may be desirable to activate the air nozzles such that the air from the nozzles is forced between the web and the bar. Typically, a roll bar that is angled with respect to the path of the web, or that turns the path of the web, for example, by a right angle, will have air flowing through its air nozzles.

According to one exemplary embodiment, the position of the second and third bars (122, 124) may be motorized. Thus, motors may be used to automatically swivel the bars from their positions shown in the x-inverter mode (100, FIG. 1) to the positions shown in the z-keeper mode (300, FIG. 3) and vice versa. A locking mechanism to hold the bars in either position after reorientation may be used to keep the bars from swiveling at undesirable times and causing problems, such as paper jams.

The change between modes may be controlled electronically by a control system such as, but not limited to, software running on a computer or an embedded system. This could enable automation of the switch between modes, thus requiring very little or no operator intervention.

As suggested, the turn-bar can automatically switch between the modes shown in FIG. 1 and FIG. 3, thereby automatically adjusting the orientation of the web. FIGS. 2A through 2D illustrate the transition from the x-inverter mode (100) shown in FIG. 1 to the z-keeper mode (300) shown in FIG. 3.

According to one exemplary embodiment, the first and fourth roll bars (120, 126) are held stationary in the transition between modes and the second and third roll bars move from their position shown in FIG. 1 to their positions shown in FIG. 3. More specifically, the second roll bar (122) swivels from a diagonal position in the x-inverter mode (100, FIG. 1) to the non-diagonal position in the z-keeper mode (300, FIG. 3) and the third roll bar (124) swivels from a non-diagonal position in the x-inverter mode (100, FIG. 1) to a diagonal position in the z-keeper mode (300, FIG. 3). As used herein, the term "diagonal position" is used to refer to a position in which a roll bar is angled with respect to the path of the web, or that turns the path of the web, for example, by a right angle.

Figure 2A:
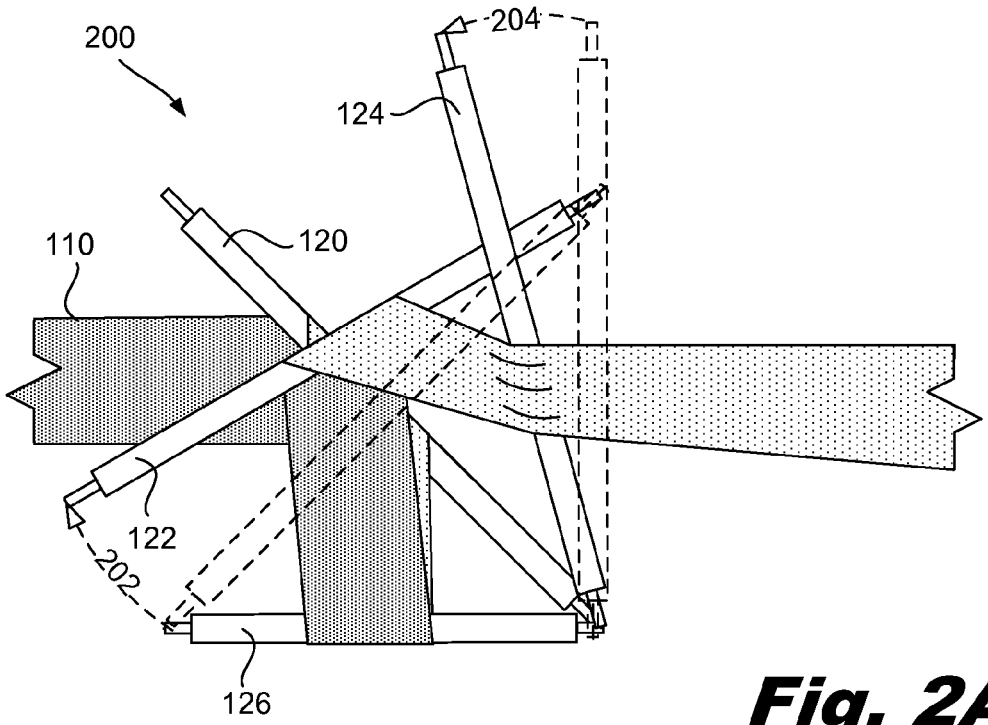
FIG. 2A is a diagram of a first stage in an illustrative transition between modes, according to one embodiment of principles described herein.

With regard to FIG. 2A, an exemplary first stage (200) of a transition between an x-inverter mode and a z-keeper mode is shown. The second roll bar (122) has moved as indicated by the arrow (202) and the third roll bar (124) has moved as indicated by the arrow (204). The first roll bar (120) and fourth roll bar (126) have not moved. At this stage of the transition, the second and third roll bars (122, 124) are just beginning to move and the web (110) is beginning to flex as it crosses over the third bar (124).

Figure 2B:
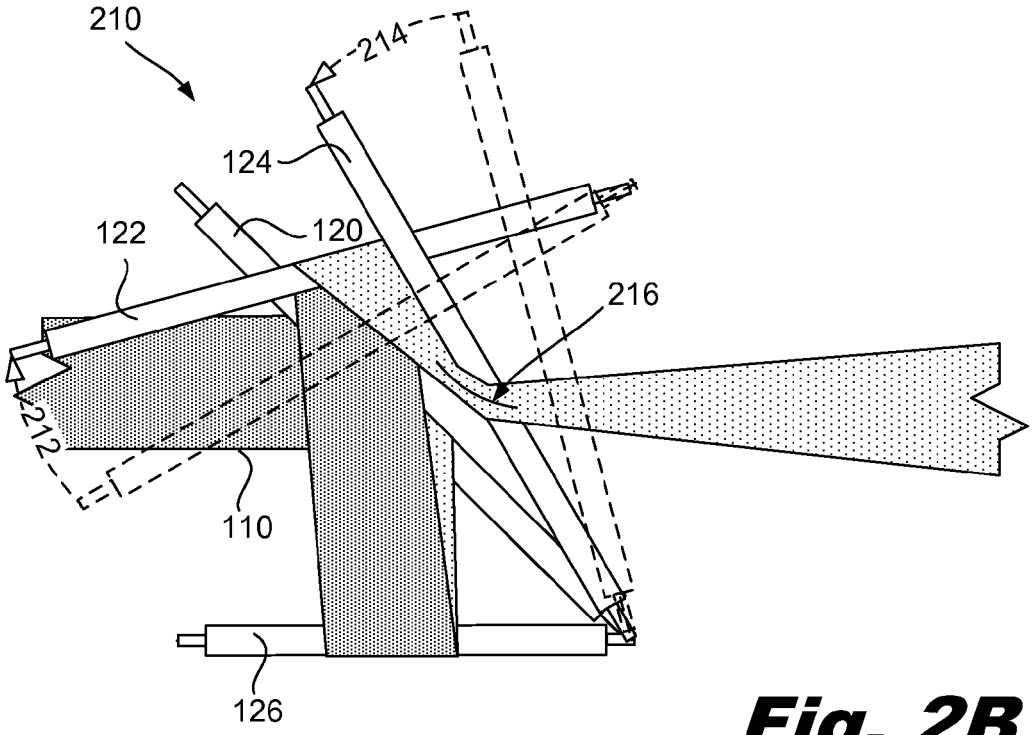
FIG. 2B is a diagram of a second stage in an illustrative transition between modes, according to one embodiment of principles described herein.

With regard to FIG. 2B, an exemplary second stage (210) of a transition between an x-inverter mode and a z-keeper mode is shown. Since the first stage (200, FIG. 2A), the second roll bar (122) has moved as indicated by the arrow (212), and the third roll bar (124) has moved as indicated by the arrow (214). The first roll bar (120) and fourth roll bar (126) have not moved. At this stage of the transition, the second and third bars (122, 124) have created a fold (216) in the web (110).

Figure 2C:
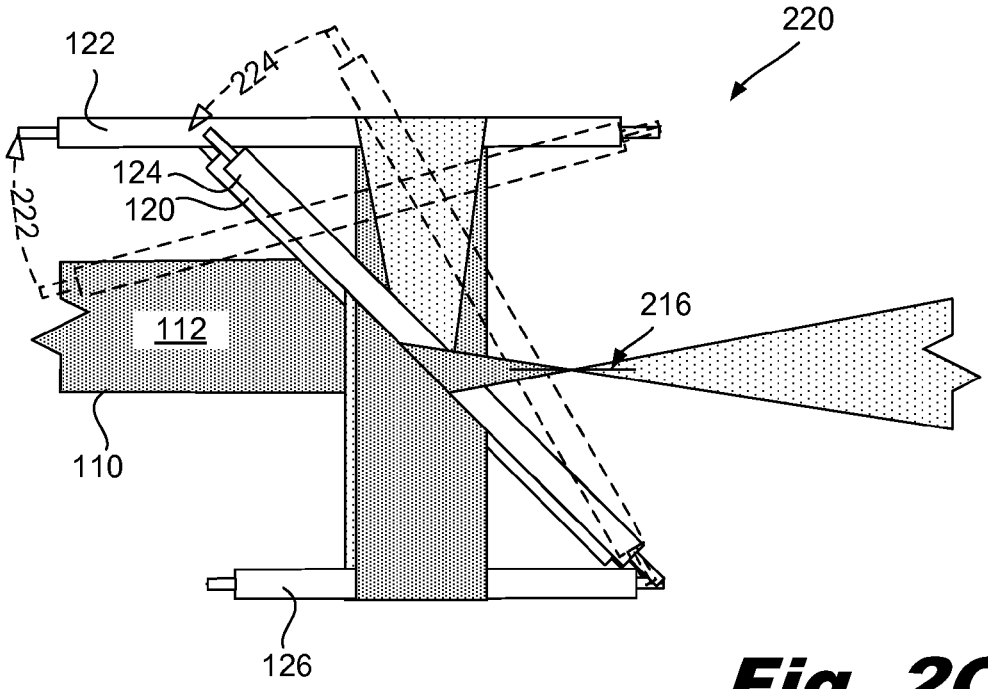
FIG. 2C is a diagram of a third stage in an illustrative transition between modes, according to one embodiment of principles described herein.

With regard to FIG. 2C, an exemplary third stage (220) of a transition between an x-inverter mode and a z-keeper mode is shown. Since the second stage (210, FIG. 2B), the second roll bar (122) has moved as indicated by the arrow (222), and the third roll bar (124) has moved as indicated by the arrow (224). The first roll bar (120) and fourth roll bar (126) have not moved. At this stage of the transition, the fold (216) has slid past the third bar (124) and allowed the web (110) to begin to be inverted at the output as shown by the exposure of the first side (112), the darker shaded portion, of the web (110) on the right side of the turn-bar.

Figure 2D:
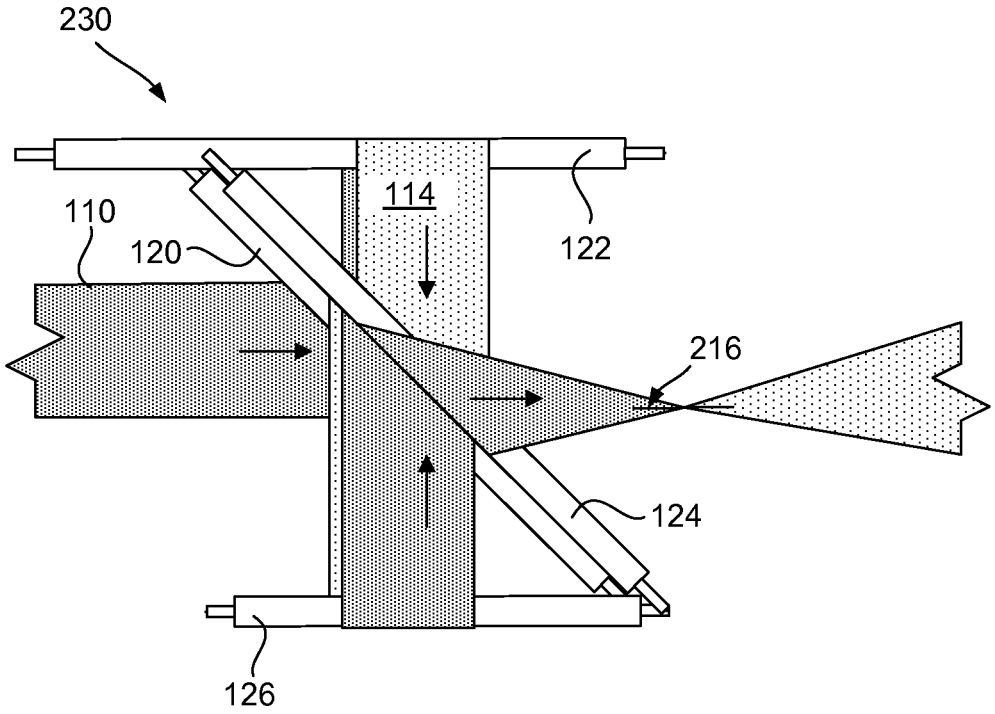
FIG. 2D is a diagram of a fourth stage in an illustrative transition between modes, according to one embodiment of principles described herein.

With regard to FIG. 2D, an exemplary fourth stage (230) of a transition between an x-inverter mode and a z-keeper mode is shown. Since the third stage (220, FIG. 2C), none of the bars (120-126) have moved. At this stage of the transition, the fold (216) is being moved out of the turn-bar. After the fold (216) is moved out of the turn-bar, printing may be resumed in the new mode. It may be desirable to wait until the fold (216) has moved past a second print engine on the right before resuming printing. According to one exemplary embodiment, a print engine to the left may begin printing before the fold (216) is removed from the turn-bar.

The transition shown in FIGS. 2A-2D results in the z-keeper mode (300) shown in FIG. 3. As previously mentioned, one or more of the roll bars (120-126) may be changed from being allowed to roll to not being allowed to roll, or vice versa. Further, one or more of the bars (120-126) may cease forcing air through a plurality of nozzles or begin forcing air through a plurality of nozzles. Diagonal bars are typically those forcing air through corresponding nozzles.

The speed of the transition shown in FIGS. 2A-2D may vary. Different web materials may allow slower or quicker transitions between modes. Also, the movement of the web through the turn-bar may be momentarily stopped, slowed, or allowed to continue during parts of the transition. As described in relation to FIG. 2D, the completion of the transition will generally require the progression of the web through the system to remove the fold (216) from printing parts of the system.

Although the transition illustrated in FIGS. 2A-2D showed that the second and third roll bars (122, 124) moved in unison to their new positions, this is only an exemplary transition. These roll bars (122, 124) may move separately or in any different combination of moves such that the beginning and ending positions are the x-inverter and z-keeper modes shown.

A similar but opposite transition may be made from the z-keeper mode (300, FIG. 3) to the x-inverter mode (100, FIG. 1) by simply reversing the movements of the bars in the transition stages shown in FIGS. 2A-2D.

As illustrated in FIGS. 2A-2D and according to one exemplary embodiment, only the second and third roll bars (122, 124) are moveable. The second and third roll bars (122, 124) may be moveable in a number of ways. For example, electric motors, servos, hydraulics, pneumatics, pulleys, hinges, gears, levers, and any number of other mechanical elements known to those of skill in the art may be used to swivel and reorient the second and third bars (122, 124) between positions.

The position of the roll bars and the corresponding mode of the turn-bar may be controlled by software, control buttons to be used by an operator, an embedded system, or many other control methods. The turn-bar may be able to provide feedback regarding the current position of the roll bars (120-126) and/or its current mode.

Figure 4:
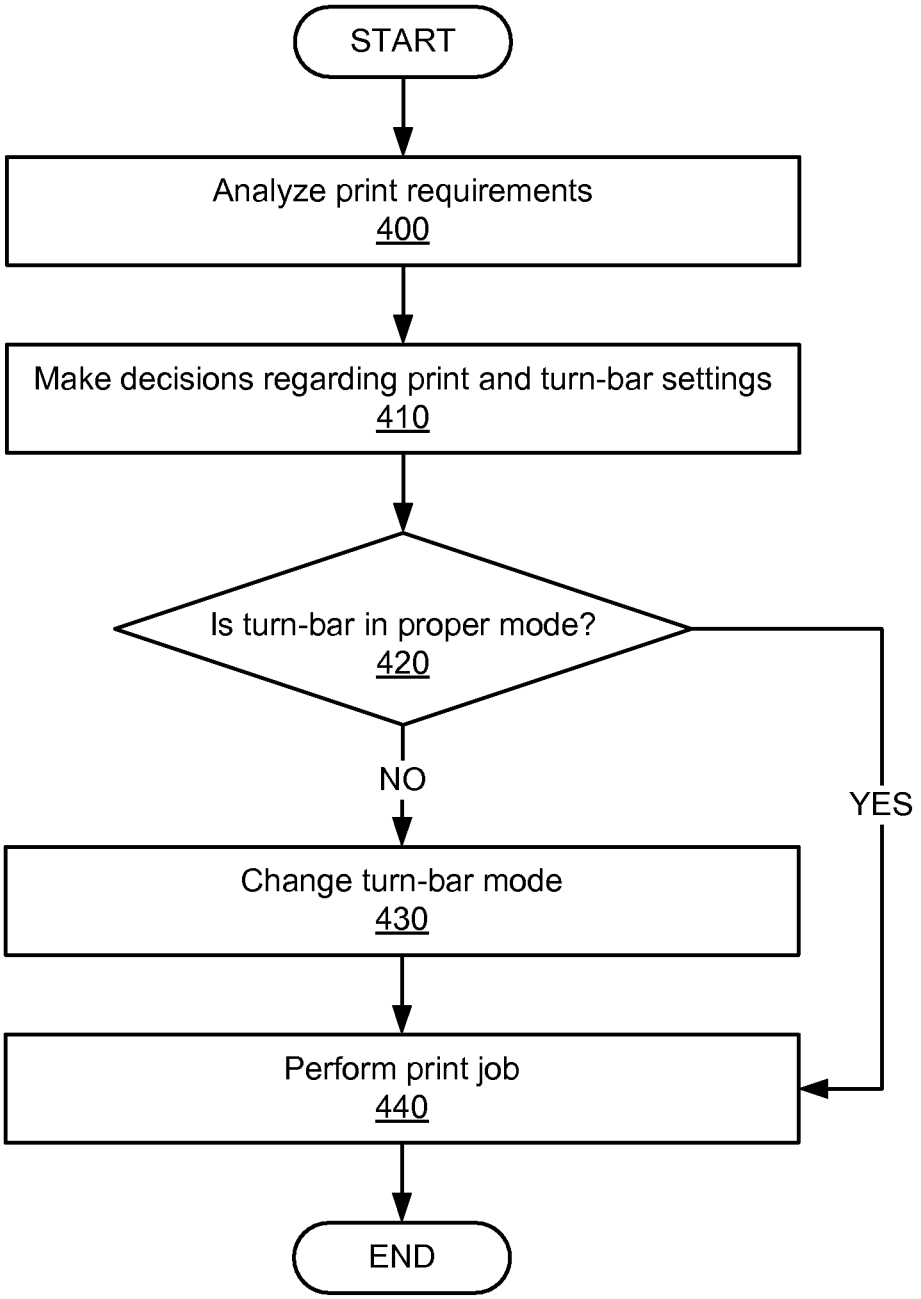
FIG. 4 is a flowchart showing an illustrative web-press printing method using an automated turn-bar, according to one embodiment of principles described herein.

FIG. 4 shows a method of printing using two or more print engines and at least one turn bar. The method begins by analyzing the print parameters of the desired print job (step 400). These parameters may include, but are not limited to, the type of web substrate, print engines, the need for double or single sided printing, what types and colors of ink need to be used, and the amounts of specific colors. Based on this information, a decision is made (step 410) regarding the best configuration of the web press, such as the turn-bar orientation or print engine settings. By way of example and not limitation, this decision may be made by automated software or taken by an operator.

After the print requirements are analyzed and a decision on the best settings for the web press system is made (step 410), the turn-bar is checked to see if it already is in the proper starting mode (step 420). By way of example and not limitation, this step may be performed by automated software running on a print engine, computer or other controller or even by the human operator.

If the turn-bar is not in the starting proper mode, the turn bar is placed in the correct mode (step 430). This step will not need to include the cutting and splicing of the web. This can be done using bars with motorized positions or the operator manually moving the bars. By way of example and not limitation, this switching between modes may be done as described in relation to FIGS. 2A-2D. If the turn-bar is already in the proper mode (step 420), step 430 may be skipped.

If more than one-turn bar is present in the system some of the steps may be repeated for each turn bar. Finally, the print job is performed (440) using the settings determined during the analysis of the print parameters (steps 400, 410).

The method shown in the flow chart in FIG. 4 may be fully automated, partially automated, or manually performed by an operator. This method allows for switching between modes with much more ease and speed. Full automation may lead to a smaller number of required operators to run many web presses or less effort by an operator to run a single press. These improvements may lead to better cost efficiency and/or higher print volumes.

The use of automated turn-bars enables great versatility in the configuration of web presses. For example, web press systems with more than two print engines could greatly profit from automated turn bars because it would take greater effort to cut, rethread and splice webs in a less sophisticated system.

Figure 5:
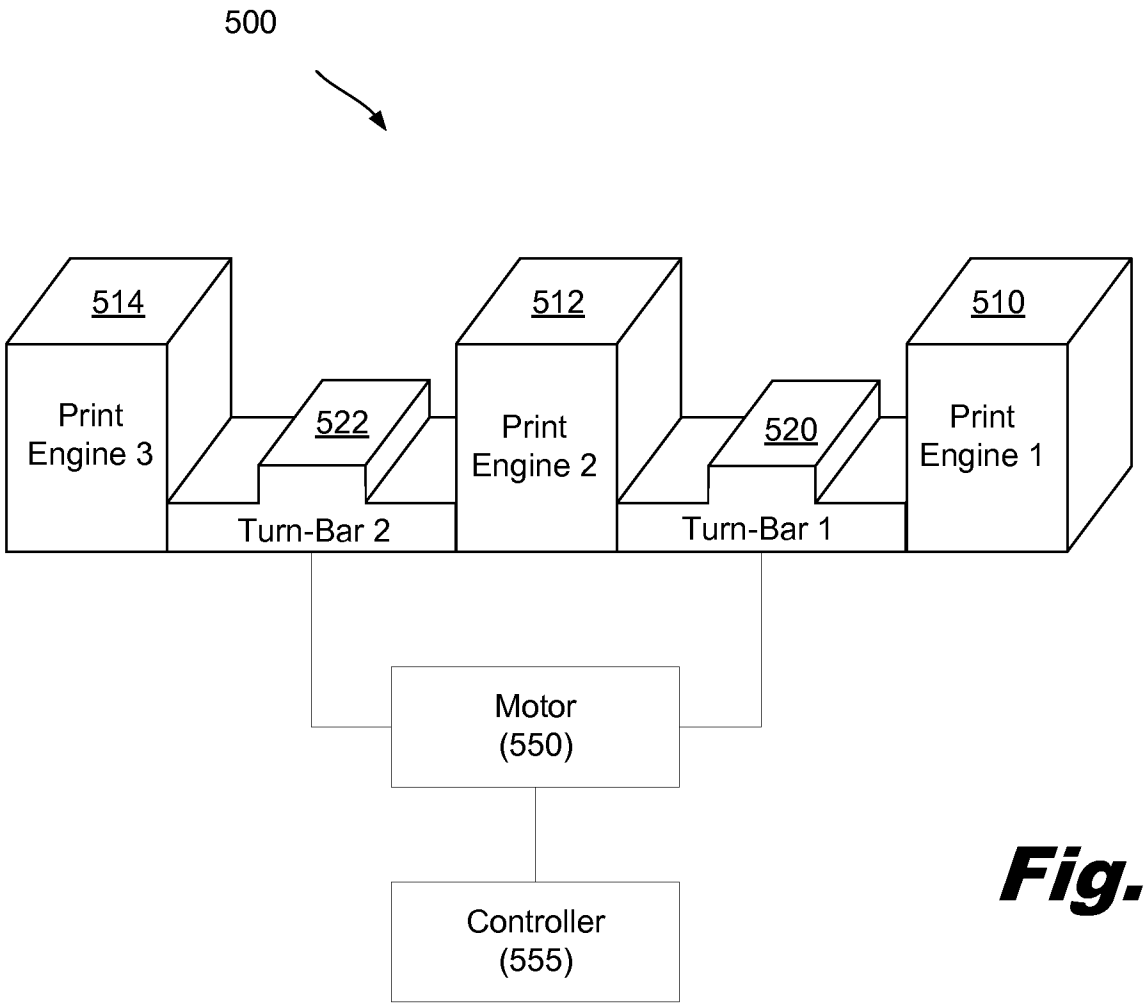
FIG. 5 is a diagram illustrating a multi print engine web press system, according to one embodiment of principles described herein.

With regard to FIG. 5, a diagram of an exemplary multi-engine web press system (500) using a first print engine (510), a second print engine (512), and a third print engine (514) is shown. Between the first and second print engines (510, 512), a first turn-bar mechanism (520) is disposed, and between the second and third print engines (512, 514), a second turn-bar mechanism (522) is disposed. The print engines (510-514) may be any type of print engine known to those skilled in the art or those which will be created in the future. According to one exemplary embodiment, the turn-bars (520, 522) are automated turn-bars as described herein.

Full automation of the multi engine press (500) is possible using control software or firmware running on one or all of the print engines, a computer, or other control device. In particular, a controller (555) may be used to automatically control one or more motors (550) or other devices that automatically reconfigure the turn-bars (520, 522) as described herein.

The use of such a multi-engine press (500) can lead to great flexibility in printing, as well as very high print speeds as the work load can be split between multiple print engines. The second and third print engines (512, 514) may selectively print on either side of a web. The system may optimize printing speeds by analyzing the colors and amounts of ink needed in a print job and configuring the turn-bars and print engines accordingly. Further, the turn-bars (520, 522) may adjust orientations in the middle of a print job to further optimize printing speeds and or quality.

The configuration show in FIG. 5 has additional benefits including the ability to service one of the printing engines (510-514) during a print job as the system can automatically adjust web orientation to account for the loss of the use of one of the engines. This can lead to the ability to replenish ink, adjust print settings, or fix a print engine while a print job is being performed.

The use of automated turn-bar mechanisms as describe herein has considerable advantage because an operator does not need to cut, rethread, and splice a web to present the proper side of the web to each successive print engine. The use of three print engines and two turn-bars is only an exemplary multi engine system. Other similar configurations may also be achieved using a varying number of print engines and/or turn-bars.

The preceding description has been presented only to illustrate and describe embodiments and examples of the principles described. This description is not intended to be exhaustive or to limit these principles to any precise form disclosed. Many modifications and variations are possible in light of the above teaching.

What is claimed is:

1. A turn-bar for adjusting orientation of a web comprising:

a plurality of roll bars;

wherein positions of at least two bars of said plurality of roll bars are movable with respect to a direction of travel of said web through said turn-bar; and wherein an orientation of said web passing through said plurality of bars is changed by adjusting said positions of said at least two bars without removal of said web from said turn-bar, such that, when the two bars that are movable with respect to the direction of travel of the web are in a first position, the web passes through said turn-bar without being inverted such that a same side of the web faces a first direction both before and after the web passes through the turn-bar, and when the two bars that are movable with respect to the direction of travel of the web are in a second position, the web is inverted such that a first side of the web faces said first direction before the web enters the turn-bar and a second side of the web faces said first direction when the web exits the turn-bar.

2. The turn-bar of claim 1, wherein said at least two bars are moveable by pivoting about an end of each said roll bar.

3. The turn-bar of claim 2, wherein changes to said positions of said at least two bars is automated.

4. The turn-bar of claim 1, further comprising a motor, wherein said at least two bars are motorized so as to be movable with respect to said direction of travel of said web.

5. The turn-bar of claim 4, further comprising a controller for automatically controlling said motor to selectively reconfigure said turn-bar to change said orientation of said web passing through said turn-bar.

6. The turn-bar of claim 1, wherein said web is not cut when said position of said at least two bars is adjusted.

7. The turn-bar of claim 1, wherein at least one of said plurality of roll bars is diagonal to the direction of travel of said web, wherein said at least one diagonal roll bar does not roll.

8. The turn-bar of claim 7, wherein said diagonal bars comprise air nozzles through which air may be forced.

9. The turn-bar of claim 8, wherein said air nozzles are selectively deactivated if said diagonal bar is moved to a different position with respect to said direction of travel.

10. The turn-bar of claim 1, wherein at least one roll bar of said plurality of roll bars can selectively roll or not roll depending on said position of said at least one roll bar.

11. The turn-bar of claim 1, wherein, when said two bars that are movable with respect to the direction of travel of the web are in said second position, said plurality of roll bars comprises two bars that cross each other at right-angles.

12. The turn-bar of claim 1, wherein, when said two bars that are movable with respect to the direction of travel of the web are in said first position, said plurality of roll bars form a Z-shape.

13. A web press system comprising:

at least two print engines; and one or more turn-bars disposed between said print engines, each said turn-bar comprising:

a plurality of roll bars;

wherein at least two bars of said plurality of roll bars are movable with respect to a direction of travel of a web through said turn-bar; and wherein an orientation of said web passing through said turn bar is changed by adjusting a position of said at least two bars without removal of said web from said turn-bar, such that a web is not inverted with respect to said print engines when the at least two bars that are movable with respect to the direction of travel of the web through the turn-bar are in a first position, and the web is inverted with respect to said print engines by passing through said turn-bar when the at least two bars that are movable with respect to the direction of travel of the web through the turn-bar are in a second position.

14. The web press system of claim 13, further comprising a motor, wherein said at least two bars are motorized so as to be movable with respect to an angle at which that roll bar crosses said direction of travel of said web.

15. The web press system of claim 13, wherein, when said two bars that are movable with respect to the direction of travel of the web are in said second position, said plurality of roll bars comprises two bars that cross each other at right-angles.

16. The web press system of claim 13, wherein, when said two bars that are movable with respect to the direction of travel of the web are in said first position, said plurality of roll bars form a Z-shape.

* * * * *